United States Patent [19]

Durham

[11] 4,010,887

[45] Mar. 8, 1977

[54] CARTON FOR EGG-SHAPED CONTAINERS

[76] Inventor: David M. Durham, P.O. Box 408, Mebane, N.C. 27302

[22] Filed: Apr. 30, 1975

[21] Appl. No.: 573,572

[52] U.S. Cl. ..... 229/21; 229/41 C; 229/89; 206/446

[51] Int. Cl.[2] ..... B65D 85/20; B65D 3/04; B65D 5/36

[58] Field of Search ..... 229/41 C, 21, 89; 206/446, 821, 430

[56] References Cited

UNITED STATES PATENTS

| | | | |
|---|---|---|---|
| 3,101,167 | 8/1963 | Styler | 229/41 C |
| 3,174,675 | 3/1965 | Rosenburg, Jr. | 229/41 C |
| 3,269,640 | 8/1966 | Arneson | 229/41 C |
| 3,411,692 | 11/1968 | Mathews | 229/41 C |
| 3,741,379 | 6/1973 | Kappler et al. | 229/51 S |
| 3,827,623 | 8/1974 | Arneson | 229/21 |
| 3,918,629 | 11/1975 | Forbes, Jr. et al. | 229/51 TS |
| 3,924,736 | 12/1975 | Bell et al. | 229/21 |

*Primary Examiner*—William Price
*Assistant Examiner*—Douglas B. Farrow

[57] ABSTRACT

A pre-cut, pre-folded carton having a hexagonally shaped, preformed bottom with upwardly extending walls which form at the top thereof a generally circular top for receiving and retaining the bottom, enlarged portion of an egg-shaped container therein. A die-cut blank is first formed with a rear wall section and a pair of front wall sections. Each section is of a height sufficient to receive the largest diameter of the egg-shaped container therein and includes depending lower flap portions. The bottom is formed by folding and gluing the lower flap sections. The resulting carton has a first, flat position in which the bottom wall is folded up between the front and rear walls, and a second, open position where the flap sections, which are already secured to form a folded bottom section, are automatically unfolded or extended to form a double-thickness, hexagonal shaped bottom wall. An upper flap folds downwardly and inwardly from the upper edges of the front and rear wall to form a retaining member of reduced diameter which prevents inadvertent removal of the container.

1 Claim, 5 Drawing Figures

CARTON FOR EGG-SHAPED CONTAINERS

BACKGROUND OF THE INVENTION

In recent years, in the merchandising of products, unique packaging methods have been developed wherein products unique packaging methods have been developed wherein products no longer are necessarily packaged in conventional rectangular shaped boxes. Rather, in an effort to stimulate sales, the packaging art has shifted to more unique and sometimes oddshaped shaped packages. One such example is an egg-shaped plastic container in which hosiery is packaged.

In order for the egg-shaped containers to be more easily stored and displayed on the shelves of retail outlets, as well as to provide a place for printed advertising and merchandising information, a generally cylindrical or tubular carton has been developed which encases the lower portion of the egg-shaped container and holds it therein until the consumer is ready to open the package.

The carton which is presently in use is a cylindrically-shaped, spirally wound, tube of a diameter approximately equal to the effective largest diameter of the egg-shaped container. The aforesaid effective largest diameter is determined by a plurality of protrusions extending outwardly from the container around the periphery thereof. An upper rim of the carton includes rolled or beaded edge which prevents easy withdrawal of the container through the top thereof. The carton further includes a disc shaped bottom wall or floor which must be inserted into the spirally wound carton either before or after the container is emplaced. In any event, the above described cylindrical container is not folded into a flat configuration, and therefore considerable space is required for shipping and storage of the cartons prior to the time the containers are filled and emplaced therein.

Also, there is generally required one or more assembly operations on the cartons at the site of the product manufacture, rather than at the site of the package manufacture. The present packaging process is therefore expensive both from the standpoint of being time consuming to the product manufacturer, as well as from the standpoint of requiring additional warehouse space and increasing shipping charges of the package before the product is inserted.

Although the present description is directed to egg-shaped containers, it is apparent that the same concepts and principles would be applicable for spherical or ellipsoidal containers, or any container that has a circular transverse cross section, regardless of the longitudinal configuration.

SUMMARY OF THE PRESENT INVENTION

The present invention, on the other hand, provides a prefabricated, prefolded and preglued carton for the container formed from a die-cut blank that is assembled by the package manufacturer, then shipped and stored in a flat condition, however when unfolded automatically forms a bottom section. This is known as an "automatic bottom" and generally the concept in itself has been known and used before. However such a bottom has not been adapted before for use with the egg-shaped containers, as is the case here.

Such a carton, as a replacement for the spirally wound tube, provides less unit cost for the end product, because of the savings in shipping and warehousing cost, as well as the economies achieved in production from using a preformed, preglued bottom portion which requires no assembly after leaving the package manufacturer. Further, the resulting carton has an improved, double-thickness bottom portion and an improved simplified retaining flap around the upper edge.

The carton of the present invention is formed by first die-cutting a blank, and providing it with hinge lines at prescribed places to form a rear panel section and two front panel sections, each of which is shorter in length than the rear panel. The two front panel sections are, however, substantially equal in cumulative length to the rear panel. Further, six lower flaps or tabs are formed integrally with the lower edge of the front and rear panels, with the edge of the flaps which adjoin the panel sections being approximately equal in length for reasons to be hereinafter described.

The blank is then folded and secured in such a manner that the first and fourth flaps are glued together and folded to form one rectangular, outer bottom panel extending diagonally across the bottom of the carton when unfolded. The second and third flaps, and likewise the fifth and sixth flaps are joined together, and upon unfolding, cooperate with each other to form a second, inner bottom wall thickness inside the first bottom thickness described hereinabove. Finally, upper flaps extending along the top edge of the front and rear panels are folded inwardly and downwardly to effect an improved retaining or locking member which prevents inadvertent removal of the container.

In the folded position, the six depending flaps are folded flat and lie between the front and rear panels. When ready for use, the front and rear panels are spread into a generally circular arrangement with the lower edges thereof forming a hexagonal pattern. The height of the front and rear walls is such that when the container is inserted, the largest diameter thereof passes downwardly beyond and is normally positioned below the retaining member, thus securing the container in the carton.

It is therefore an object of the present invention to provide an improved prefabricated carton for egg-shaped containers.

It is another object of the present invention to provide an improved carton for egg-shaped container adapted for shipping and storage in a flattened, knocked-down condition prior to the time the egg-shaped container is inserted.

It is yet another object of the present invention to provide an improved carton for egg-shaped container of the type described in which the bottom wall thereof is pre-formed and attached to both the front and rear panels and is automatically unfolded to form a hexagonal bottom portion responsive to the spreading of the front and rear walls into a generally cylindrical configuration.

Yet another object of the present invention is to provide a prefabricated carton for egg-shaped container which includes an improved retaining member for insuring retention of the container in its seated position in the carton.

It is still another object of the present invention to provide an improved carton for receiving egg-shaped containers which may be manufactured and shipped by the carton manufacturer to the customer in a flattened, knocked-down condition, yet which the customer may utilize merely by spreading the front and rear wall without any additional assembly or securing operations.

Other objects and a fuller understanding of the present invention will be apparent from an understanding of the the following detailed description of a preferred embodiment read in conjunction with the accompanying drawings, in which.

Figure 1:
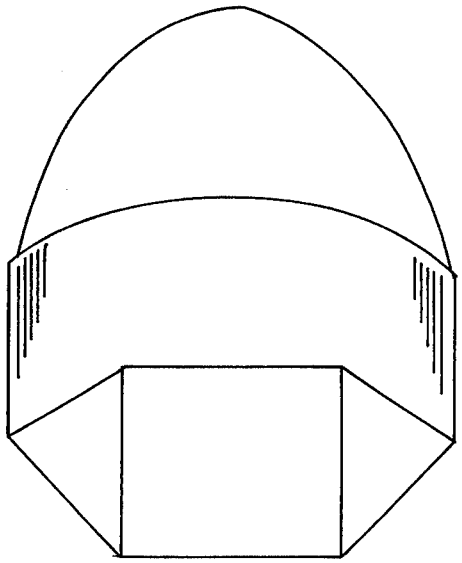
FIG. 1 is a perspective view of the assembly of the carton according to the present invention and the egg-shaped container, looking slightly from the side and beneath the package.
Figure 2:
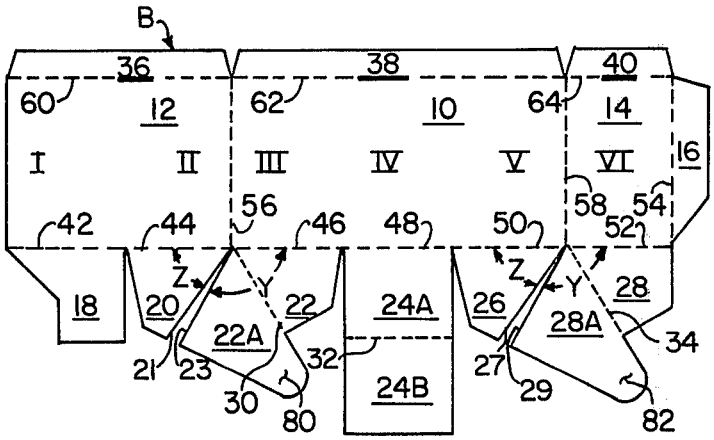
FIG. 2 is a plan view of the die-cut blank which is first formed in the manufacture of the carton according to the present invention.
Figure 3:
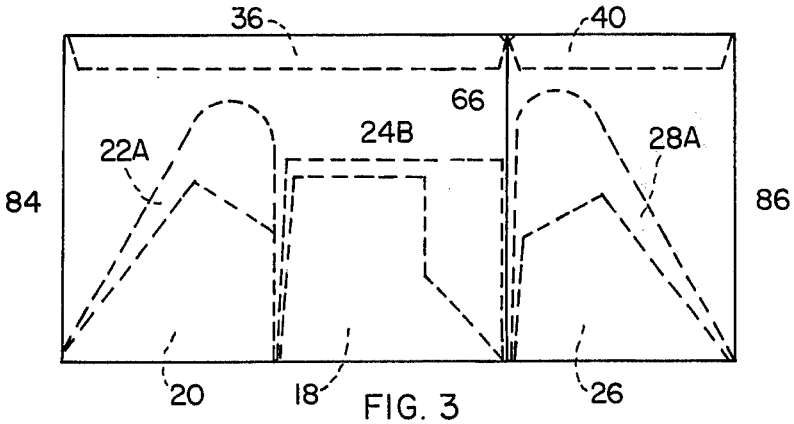
FIG. 3 is a plan view similar to FIG. 2, except showing the carton as it appears in the folded and flattened condition for shipping.

Turning now to the drawings, as illustrated in FIG. 1, the present invention is directed to a base carton A for containers C of the type having egg-shaped, spherical, ellipsoidal or similar configurations. A die-cut, scored, prefolded and pre-glued blank means B, illustrated in FIG. 2, is adapted to be shipped and stored in a first, flat position as illustrated in FIG. 3 and unfolded to an open, second position, illustrated in FIGS. 1, 4 and 5 for receiving the container C.

The blank means B includes a front wall made up of panel sections 12 and 14, a rear wall 10, and a bottom wall means which is formed lower flaps 18, 20, 22, 24, 26 and 28. The aforementioned flaps which formed the bottom wall means are so connected to the lower edge of the front and rear walls 12, 14, 10, that when the carton A is in the position illustrated in FIG. 3, the flaps forming the bottom wall means are folded up in between the front and rear walls. When the carton is opened, the flaps forming the bottom wall means are resultingly moved to a second position forming a double thickness bottom wall, and no further application of adhesive or securing means of any kind is required. An upper retaining member is formed by upper flaps 36, 38, 40 which are folded inwardly and downwardly, and prevents inadvertent removal of the container.

Turning now to the specifics of the die-cut blank B, as mentioned hereinabove, the front and rear walls are formed of panel sections 10, 12, and 14. It should be noted that the length of panel section 10 is equal to the aggregate or cumulative length of sections 12, 14, so that the front and rear walls are of the same length. End flap 16 is provided, and when assembled, is tucked in behind panel 12 and glued thereto to secure panels 14 and 12 together to form the front wall.

For the purpose of description and to illustrate the formation of the hexagonal bottom shape, reference designations I-VI refer to six equal length panel areas on the front and rear walls, each panel length being determined by the length of the hinge line joining that panel section with its corresponding flap 18–28. Therefore, flaps 18, 20, 22, 24, 26, 28 are joined to panel sections I-VI at hinge lines 42, 44, 46, 48, 50, 52 respectively. It should be noted that hinge or fold lines 42, 44, 46, 48, 50 and 52 are all equal in length and form the six edges of the hexagonal bottom wall.

Flaps 22 and 28 include a main portion and an auxiliary portion 22*a* and 28*a* respectively. During assembly, flap 20 is moved into overlapping arrangement with flap area 22*a* and flap 26 is moved into overlapping arrangement with flap area 28*a*, it being understood that the edge 23 of flap 22*a* is approximately equal in length to hinge line 44 and the edge 29 of flap area 28*a*, is approximately equal in length to hinge line 50. Therefore, when the flaps 20 and 26 are moved into overlapping arrangement with flaps 22*a* and 28*a*, each of these two assemblies forms two successive side portions of the hexagonal bottom wall. The included angle *Y* between hinge line 46 and edge 23 and between hinge line 52 and edge 29 is approximately 120°, as this is the included angle between adjacent sides of a hexagon. Likewise, the included angle *z* between hinge line 44 and edge 21 and between hinge line 50 and edge 27 of flaps 20 and 26 respectively is approximately 60° or slightly less, so that edge 21 in the assembled position falls on or slightly short of hinge line 30 of flap 22 and edge 27 will fall on or slightly short of hinge line 34 of flap 28. It should be understood that if the edges 21 and 27 were to extend past fold line 30 and 34 respectively, the bottom wall could not be folded properly unless these edges were also scored and hinged along similar hinge lines.

By way of explanation, in FIG. 2 the dash lines indicate that a fold is made upwardly from the plane of the drawing while a dotted line indicates that a fold is made downwardly from the drawing plane.

In the aforementioned securing of flaps 20, 22, 26 and 28, it should be understood that in order to effect such a step, each of the flaps must first be folded up along its corresponding fold line 44, 46, 50, 52 and front panel sections 12 and 14 must be folded up along fold lines 56, 58 respectively. Then, in order to enable the assemblage of flaps 20, 22 and 26, 28 to be folded into position as shown in FIG. 2, flaps 22*a* and 28*a* must be folded down along fold lines 30, 34. The underside of flap 20 is then secured to the upper surface of flap 22*a*, and similarly flap 26 is secured to 28*a*. The aforementioned flap assemblage provides in the open position, one layer or thickness of the bottom wall. At this time attention is called to tab extensions 80, 82 which extend outwardly from flap sections 22*a*, 28*a* respectively. The reason for these tab extensions will be explained hereinbelow during the movement of the carton to the open position.

There remains only the forming of the other bottom section which is effected by securing the underside of flap 18 to the upper surface of flap 24*b*. Flap 24*a*,24*b* forms the other bottom wall thickness and is folded down along fold line 32, so that in the folded position shown in FIG. 2, the bottom wall portion 24 fits up between the front and rear walls in a position between the other bottom wall sections as illustrated in FIG. 2.

Finally, the upper, longer tabs 36, 38 and 40 are folded up along fold lines 60, 62, 64, so that in the folded position the free edge of the tabs or flaps 36, 38 and 40 are initially spaced from the front and rear panels 10, 12, 14 in a position between the upper edges of the front and rear panels. This folding operation of tabs 36, 38 and 40 may either be done by the manufacturer of the carton before shipping, or may be accomplished as part of the operation of assembling the egg-shaped container within the carton. Preferably the folding operation occurs during the latter operation. The function of these upper tabs or flaps 36, 38, 40 will be explained hereinbelow.

Figure 4:
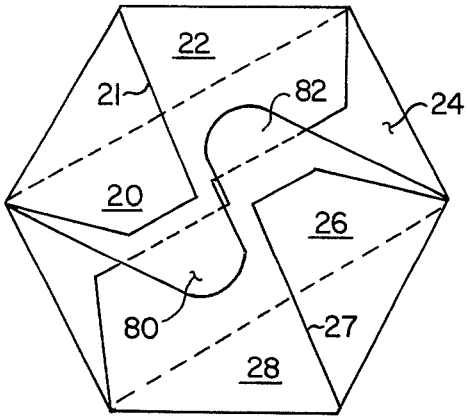
FIG. 4 is a plan view, looking down on the interior of the bottom wall of a carton of the present invention in the unfolded or open position preparatory to receiving the egg-shaped container.
Figure 5:
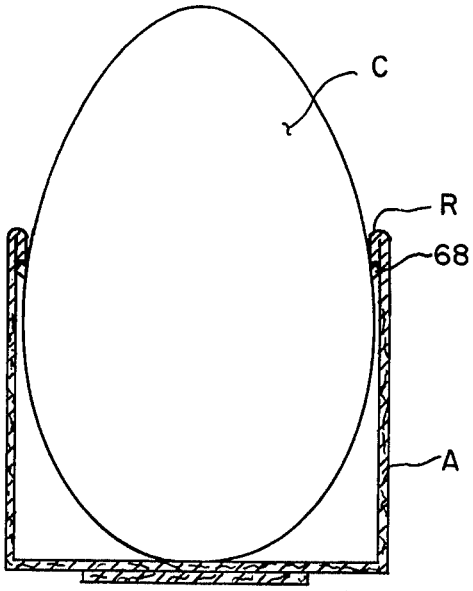
FIG. 5 is a sectional view of the carton/container assembly taken substantially along line 5—5 in FIG. 1.

Therefore it can be seen that the blank B is first formed as a knock-down flattened carton A for shipping and storage, however upon use it is only necessary to squeeze the ends 84, 86 illustrated in FIG. 2 toward each other to effect a spreading of front and rear walls into a generally cylindrical configuration. Upon squeezing of ends 84, 86 together, the double-thickness bottom wall is automatically formed as illustrated in FIG. 4. The flap 24*a*, 24*b* with flap 18 secured thereto stretches between the lower edges of panel areas I and IV to form the outer bottom thickness, the flap 22, 22*a* with flap 20 secured thereto unfolds to form two adjacent side edges of the bottom and half of the inner bottom wall thickness, while the flap 28, 28*a*, with flap 26 secured thereto unfolds to form the other two side edges of the hexagonal configuration and the other half of the inner bottom wall thickness. As the front and rear walls are spread and the bottom automatically formed, tabs 80, 82 overlap a portion of the opposite flaps 28, 22 to lock in the inner bottom thickness as illustrated in FIG. 4, thus forming a complete and continuous bottom wall thickness inside or toward the interior of the carton from the outer bottom wall thickness 24.

The carton A is then ready for insertion of container C as illustrated in FIG. 4. Container C conventionally includes a plurality of projections 68 extending outwardly from the surface thereof at a point approximately along the periphery corresponding to the largest diameter thereof, whereby an even greater effective diameter is circumscribed. In the egg-shaped container C, the greatest diameter is at a point slightly nearer the bottom than the top. When the container C is pushed downwardly into carton A, projections 68 are move beneath the retaining member formed of folded down upper flaps 36, 38 and 40. The retaining member then springs radially inwardly due to the natural bias caused by the folding of flaps 36, 38, 40 about hinge lines 60, 62, 64 to resist withdrawal of the container therefrom.

It is obvious that various changes and modifications may be made to the details of construction without departing grom the general spirit of the invention as set forth in the appended claims.

What is claimed is:

1. A collapsible base carton for egg-shaped containers of the type having a circular transverse cross-section, wherein the diameter of said cross-section varies from top to bottom, with the largest effective diameter being slightly nearer the bottom than the top and formed by a plurality of radially extending projections, wherein said base carton comprises:

a. a die-cut, pre-folded pre-glued blank means having a first, flattened or knocked down position and a second, unfolded or open position for receiving said containers;

b. said blank means including a front wall, rear wall, and a pre-formed, pre-glued bottom wall means;

c. said bottom wall means being so connected to the lower edge of said front and rear walls, that when said blank is in said first, flat position, said pre-formed bottom wall means is folded up in between said front and rear walls, and when said blank is opened to said second position, said bottom wall means is resultingly moved to an extended position forming a double thickness, bottom wall without the necessity of any further securing means;

d. each of said front and rear walls including a retaining means along the top edge thereof, said retaining means comprising at least one downwardly and inwardly foldable flap, and upon folding, the lower free edge of said flap is initially spaced from the corresponding front or rear wall defining a diameter less than the said largest effective diameter of said container with the projections to provide a resiliently biased retaining means; and e. the distance between the lower edge of said flaps and the bottom wall of said carton is greater than the vertical distance between the bottom of said egg-shaped container and the horizontal plane containing said projections, wherein when said container is emplaced in said carton, the largest effective diameter of said container is below said retaining means.

* * * * *